US007434301B1

(12) United States Patent
Johnson

(10) Patent No.: US 7,434,301 B1
(45) Date of Patent: Oct. 14, 2008

(54) SHOULDER PROTECTING ASSEMBLY

(76) Inventor: Homer L. Johnson, 243 Deer Trail Happy Valley, Whitefish, MT (US) 59937

( * ) Notice: Subject to any disclaimer, the term of this patent is extended or adjusted under 35 U.S.C. 154(b) by 424 days.

(21) Appl. No.: 10/993,876

(22) Filed: Nov. 22, 2004

(51) Int. Cl.
*A41D 13/00* (2006.01)

(52) U.S. Cl. ..... 29/45

(58) Field of Classification Search ..... 2/459, 2/44, 45, 267, 268, 310, 326–328, 460; 224/264
See application file for complete search history.

(56) References Cited

U.S. PATENT DOCUMENTS 1,037,381 A * 9/1912 Wennerstrom ..... 224/264
2,858,545 A 11/1958 Silverman
3,052,886 A 9/1962 White
3,710,391 A * 1/1973 McGlynn ..... 2/460
3,862,709 A * 1/1975 Roshaven ..... 224/264
3,940,039 A * 2/1976 Sasaki ..... 224/264
4,386,723 A * 6/1983 Mule ..... 224/150
4,879,768 A 11/1989 McClees et al.
4,887,318 A * 12/1989 Weinreb ..... 2/268
5,507,422 A 4/1996 Shields
5,590,826 A 1/1997 Endo
D417,543 S 12/1999 Gable
6,318,609 B1 * 11/2001 Swierz ..... 224/264
6,467,661 B1 * 10/2002 Mistretta et al. ..... 224/264
6,925,656 B2 * 8/2005 Henderson ..... 2/310

* cited by examiner

*Primary Examiner*—Tejash Patel

(57) ABSTRACT

A shoulder protecting assembly includes an article of clothing that is removably worn on a shoulder. A panel has a top side, a bottom side, first end, a second end, a first lateral edge and a second lateral edge. The panel is arcuate from the first end to the second end so that the bottom side is concave. The panel is comprised of a resiliently compressible material. A plate is positioned within the panel and generally extends between the first and second ends. The plate is comprised of a rigid material. A fastening assembly releasably attaches the bottom side of the panel to an outer surface of the clothing so that the panel is positioned over the shoulder. A strap may be positioned on the upper side of the panel.

13 Claims, 3 Drawing Sheets

SHOULDER PROTECTING ASSEMBLY

BACKGROUND OF THE INVENTION

1. Field of the Invention

The present invention relates to shoulder guard devices and more particularly pertains to a new shoulder guard device for preventing pain and discomfort caused by supporting a strap with a shoulder.

2. Description of the Prior Art

The use of shoulder guard devices is known in the prior art. U.S. Pat. No. 5,507,422 describes a contoured pad that may be worn over a shoulder for aiding in the distribution of weight of a strap being carried on a shoulder. Another type of shoulder guard device is U.S. Pat. No. 5,590,826 which comprises a pad assembly having a clip thereon for aiding in the retaining of strap being carried on a shoulder. Yet another such device is found in U.S. Pat. No. 4,879,768 and is adapted for being attached to a strap for the purpose of preventing the strap from slipping off of a shoulder.

While these devices fulfill their respective, particular objectives and requirements, the need remains for a device that is removably attachable to a user's clothing so that the device will not easily slip off of their shoulder while it is being used for distributing the weight of a strap. This is particularly useful for straps which are being used for supporting a rifle or shotgun. In such cases, it is essential that a person not accidentally drop the firearm, which could cause a discharge of the firearm. Additionally, such a device would aid in the prevention of the loss of a firearm when a person stumbles or falls, or the causing of a fall due to a lost firearm. Such a loss may cause damage to the firearm or accidental discharge of the firearm.

SUMMARY OF THE INVENTION

The present invention meets the needs presented above by generally including an article of clothing that is removably worn on a shoulder. A panel has a top side, a bottom side, first end, a second end, a first lateral edge and a second lateral edge. The panel is arcuate from the first end to the second end so that the bottom side is concave. The panel is comprised of a resiliently compressible material. A plate is positioned within the panel and generally extends between the first and second ends. The plate is comprised of a rigid material. A fastening assembly releasably attaches the bottom side of the panel to an outer surface of the clothing so that the panel is positioned over the shoulder. A strap may be positioned on the upper side of the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
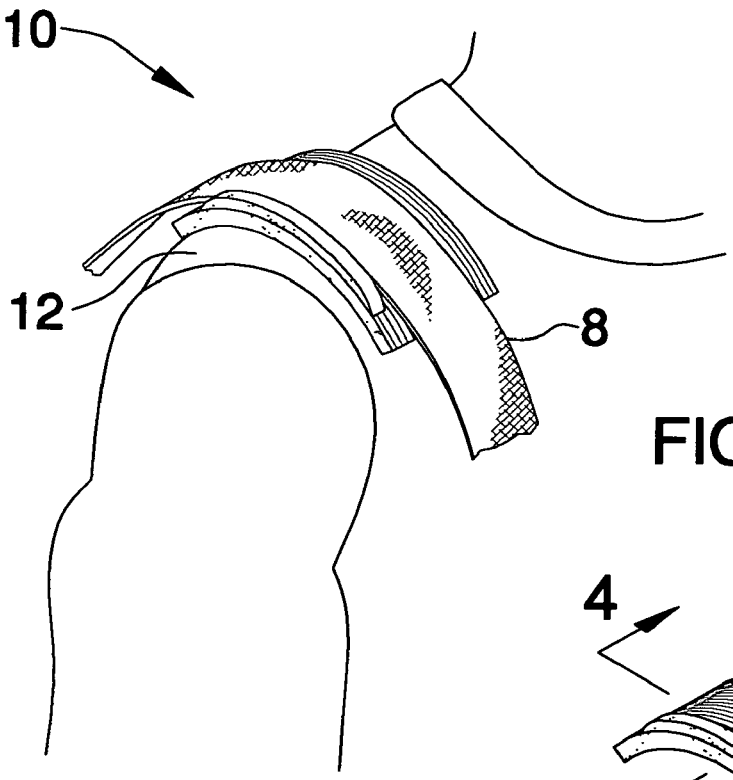
FIG. 1 is a perspective view of a shoulder protecting assembly according to the present invention.
Figure 2:
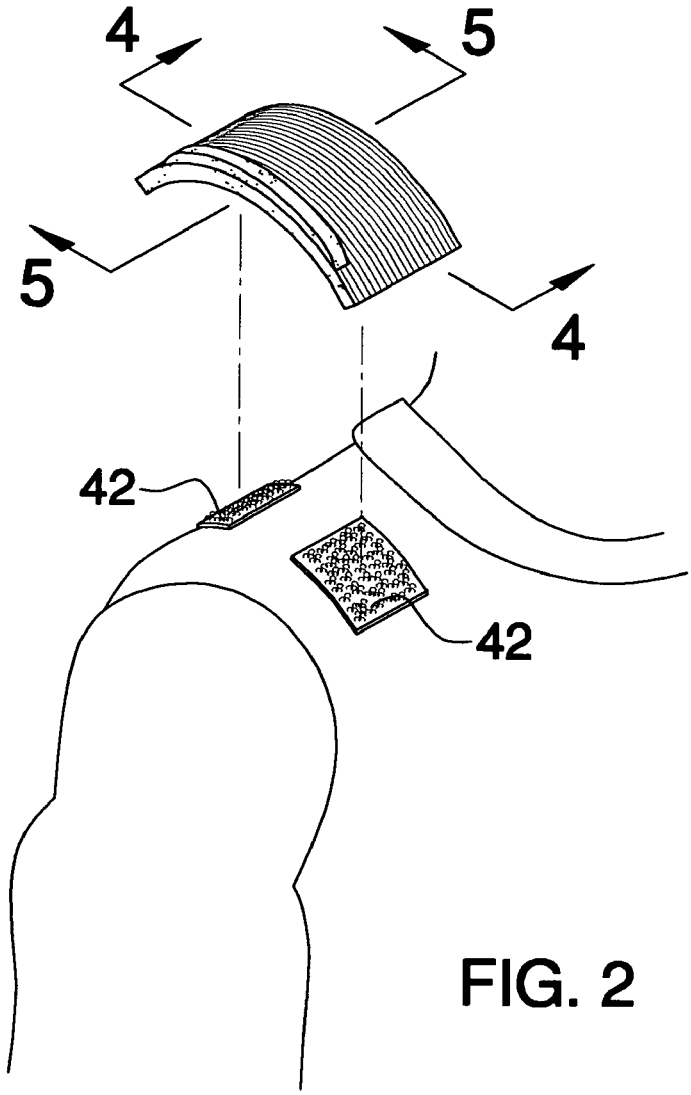
FIG. 2 is a perspective view of the present invention.
Figure 3:
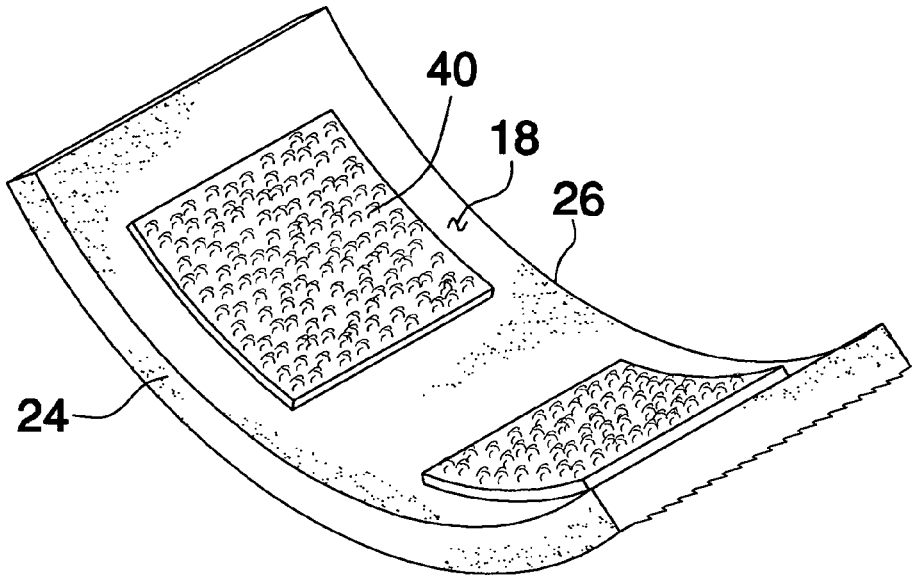
FIG. 3 is a perspective bottom view of the present invention.
Figure 4:
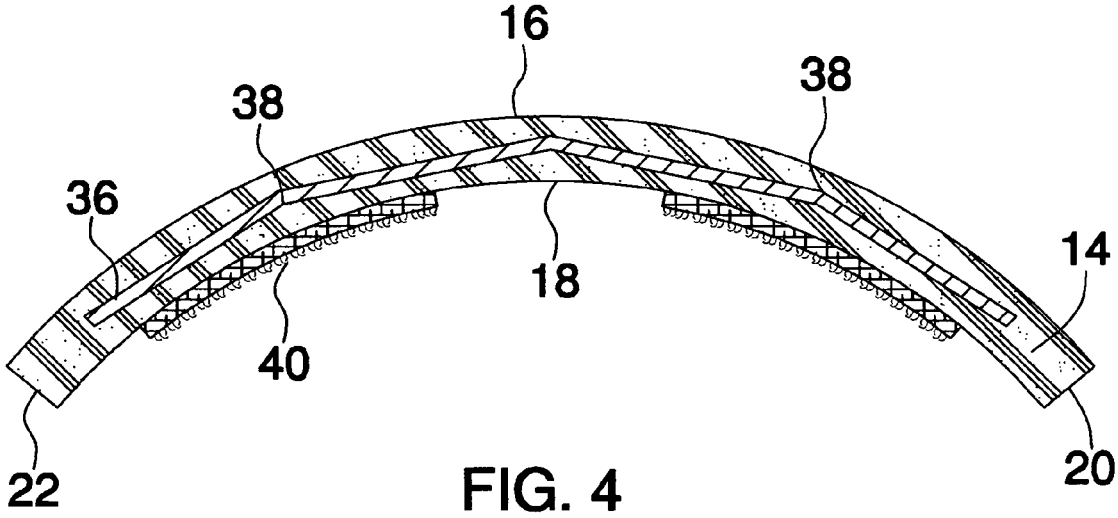
FIG. 4 is a cross-sectional view taken along line 4-4 of FIG. 2 of the present invention.
Figure 5:
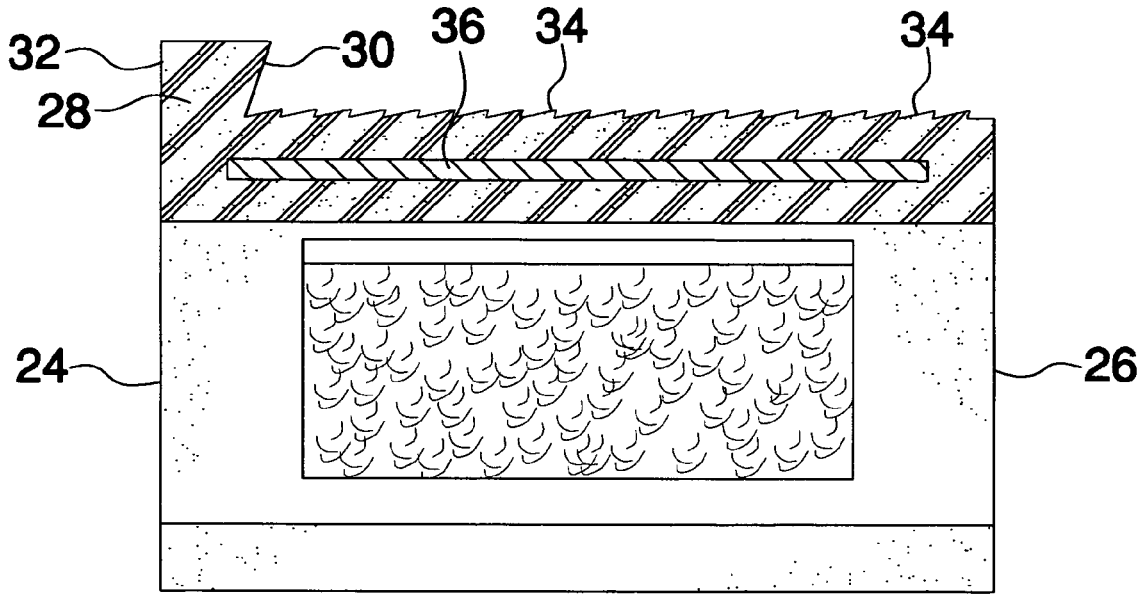
FIG. 5 is a cross-sectional view taken along line 5-5 of FIG. 2 of the present invention.

With reference now to the drawings, and in particular to FIGS. 1 through 6 thereof, a new shoulder guard device embodying the principles and concepts of the present invention and generally designated by the reference numeral 10 will be described.

As best illustrated in FIGS. 1 through 6, the shoulder protecting assembly 10 generally includes a conventional article of clothing 12 that is removably positioned on the shoulder and most likely covers the entire torso. The article of clothing 12 may include any type of clothing such as shirts, jackets and the like.

A panel 14 has a top side 16, a bottom side 18, first end 20, a second end 22, a first lateral edge 24 and a second lateral edge 26. The panel 14 is arcuate from the first end 20 to the second end 22 so that the bottom side 18 is concave. The panel 14 is comprised of a resiliently compressible material such as foamed elastomer. An upwardly extending lip 28 is attached to the top side 16. The lip 28 extends along and is positioned adjacent to the first lateral edge 24. The lip 28 has a distal side 30 and a proximal side 32 with respect to the first lateral edge 24. The distal side 30 is angled inward toward the first lateral edge 24. The top side 16 has a plurality of elongated teeth 34 therein extending from the first end 20 to the second end 22. Each of the teeth 34 is angled with respect to the first lateral edge 24 so that each is angled downward from the second lateral edge 26 toward the first lateral edge 24.

A plate 36 is positioned within the panel 14 and generally extends between the first 20 and second 22 ends. The plate 36 is comprised of a rigid material, which is preferably aluminum though other metallic or plastic materials may be used. The plate 36 may include one or more bends 38 therein to prevent buckling or deformations of the plate 36 when a weight is placed on the panel 14. The bends 38 also aid in the distribution of weight along the panel 36 and along a shoulder when the panel 36 is positioned thereon.

A fastening assembly releasably attaches the bottom side 18 of the panel 14 to an outer surface of the clothing 12 so that the panel 14 is positioned over the shoulder. The fastening assembly includes a first engaging member 40 attached to the bottom side 18 and a second engaging member 42 that is releasably attached to the clothing 12. The second engaging member 40 may be attached to the clothing 12 with a pressure sensitive adhesive. The first 40 and second 42 engaging members ideally comprise a hook and loop fastening means. It should be understood that alternate fastening assemblies such as adhesives that are positioned on the bottom side 14 may also be utilized to secure the panel to the clothing 12.

Figure 6:
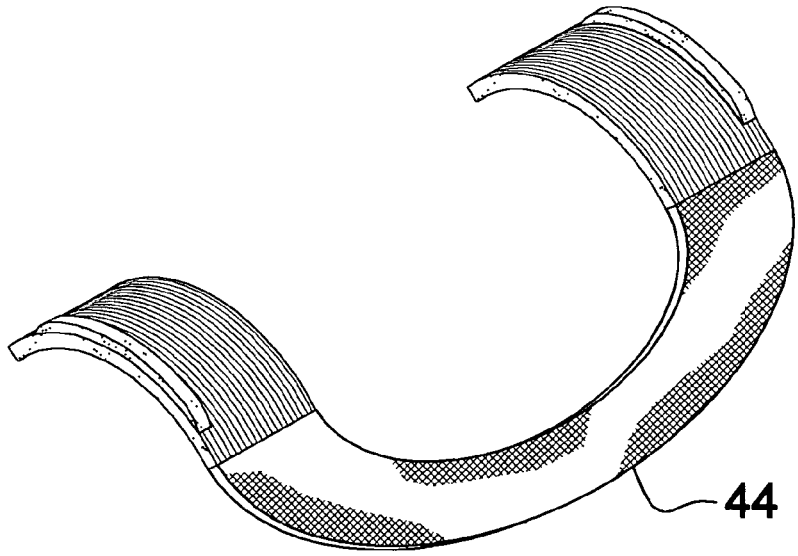
FIG. 6 is a perspective view of a second embodiment of the present invention.

FIG. 6 depicts a second embodiment of the assembly which includes a pair of assemblies 10 attached together with a back support 44 to aid in retaining the assemblies 10 on the shoulders.

In use, a strap 8, such as the type used for carrying a rifle or shotgun, may be positioned on the top side 16 of the panel 14. The panel 14 and its internal plate 36 prevent discomfort to the shoulder due to the weight of the gun. The teeth 34 and lip 28 each aid the user of the assembly 10 in retaining the strap 8 on the panel. In particular, the distal side 30, by being angled, will prevent a strap from falling off of the panel 14.

Additional uses for the assembly 10 include the relief of fatigue and stress due to carrying backpacks and other shoulder strap supported weights.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoulder guard device for protecting a shoulder from a strap, said device comprising:

an article of clothing being removably positioned on the shoulder;

a panel having a top side, a bottom side, first end, a second end, a first lateral edge and a second lateral edge, said panel being arcuate from said first end to said second end such that said bottom side is concave, said panel being comprised of a resiliently compressible material said top side having a plurality of elongated teeth therein extending from said first end to said second end, each of said teeth is angled with respect to said first lateral edge;

a plate being positioned within said panel and generally extending between said first and second ends, said plate being comprised of a rigid material;

a fastening assembly for releasably attaching said bottom side of said panel to an outer surface of the clothing such that said panel is positioned over the shoulder; and wherein a strap may be positioned on said top side of said panel.

2. The device according to claim 1, wherein said fastening assembly includes a first engaging member attached to said bottom side and a second engaging member being releasably attached to the clothing.

3. The device according to claim 2, wherein said first and second engaging members comprise a hook and loop fastening means.

4. The device according to claim 1, further including an upwardly extending lip being attached to said top side, said lip extending along and being positioned adjacent to said first lateral edge.

5. The device according to claim 4, wherein said lip has a distal side and a proximal side with respect to said first lateral edge, said distal side being angled inward toward said first lateral edge.

6. A shoulder guard device for protecting a shoulder from a strap, said device comprising:

an article of clothing being removably positioned on the shoulder;

a panel having a top side, a bottom side, first end, a second end, a first lateral edge and a second lateral edge, said panel being arcuate from said first end to said second end such that said bottom side is concave, said panel being comprised of a resiliently compressible material, an upwardly extending lip being attached to said top side, said lip extending along and being positioned adjacent to said first lateral edge, said lip having a distal side and a proximal side with respect to said first lateral edge, said distal side being angled inward toward said first lateral edge, said top side having a plurality of elongated teeth therein extending from said first end to said second end, each of said teeth being angled with respect to said first lateral edge;

a plate being positioned within said panel and generally extending between said first and second ends, said plate being comprised of a rigid material;

a fastening assembly for releasably attaching said bottom side of said panel to an outer surface of the clothing such that said panel is positioned over the shoulder, said fastening assembly including a first engaging member attached to said bottom side and a second engaging member being releasably attached to the clothing, said first and second engaging members comprising a hook and loop fastening means; and wherein a strap may be positioned on said top side of said panel.

7. A shoulder guard system comprising;

a strap;

an article of clothing being removably positioned on the shoulder;

a panel having a top side, a bottom side, first end, a second end, a first lateral edge and a second lateral edge, said panel being arcuate from said first end to said second end such that said bottom side is concave, said panel being comprised of a resiliently compressible material a plate being positioned within said panel and generally extending between said first and second ends, said plate being comprised of a rigid material;

a fastening assembly for releasably attaching said bottom side of said panel to an outer surface of the clothing such that said panel is positioned over the shoulder; and said strap being positioned on said top side of said panel and being unsecured to said panel.

8. The device according to claim 7, further including an upwardly extending lip is attached to said top side, said lip extending along and being positioned adjacent to said first lateral edge.

9. The device according to claim 8, wherein said lip has a distal side and a proximal side with respect to said first lateral edge, said distal side being angled inward toward said first lateral edge.

10. The device according to claim 7, wherein said top side has a plurality of elongated teeth therein extending from said first end to said second end.

11. The device according to claim 7, wherein said fastening assembly includes a first engaging member attached to said bottom side and a second engaging member being releasably attached to the clothing.

12. The device according to claim 11, wherein each of said teeth is angled with respect to said first lateral edge.

13. The device according to claim 11, wherein said first and second engaging members comprise a hook and loop fastening means.

* * * * *